US008540590B2

(12) United States Patent
Tsukada et al.

(10) Patent No.: US 8,540,590 B2
(45) Date of Patent: Sep. 24, 2013

(54) HOLLOW GOLF CLUB HEAD

(75) Inventors: Daisuke Tsukada, Niigata (JP); Tomonari Funayama, Niigata (JP); Toshimitsu Oyamatsu, Niigata (JP)

(73) Assignee: K.K. Endo Seisakusho, Niigata (JP)

( * ) Notice: Subject to any disclaimer, the term of this patent is extended or adjusted under 35 U.S.C. 154(b) by 183 days.

(21) Appl. No.: 13/158,700

(22) Filed: Jun. 13, 2011

(65) Prior Publication Data

US 2011/0306441 A1 Dec. 15, 2011

(30) Foreign Application Priority Data

Jun. 14, 2010 (JP) ..... 2010-135562

(51) Int. Cl.
*A63B 53/04* (2006.01)

(52) U.S. Cl.
USPC ..... 473/345; 473/346; 473/349

(58) Field of Classification Search
USPC ..... 473/324–350, 287–292
See application file for complete search history.

(56) References Cited

U.S. PATENT DOCUMENTS

| | | | | |
|---|---|---|---|---|
| 6,783,465 | B2 * | 8/2004 | Matsunaga | 473/329 |
| 6,949,031 | B2 * | 9/2005 | Imamoto et al. | 473/329 |
| 7,108,614 | B2 * | 9/2006 | Lo | 473/345 |
| 7,250,007 | B2 * | 7/2007 | Lu | 473/329 |
| 7,258,624 | B2 * | 8/2007 | Kobayashi | 473/324 |
| 7,303,488 | B2 * | 12/2007 | Kakiuchi et al. | 473/346 |
| 7,448,964 | B2 * | 11/2008 | Schweigert et al. | 473/345 |
| 7,510,485 | B2 * | 3/2009 | Yamamoto | 473/345 |
| 7,988,565 | B2 * | 8/2011 | Abe | 473/328 |
| 8,172,697 | B2 * | 5/2012 | Cackett et al. | 473/329 |
| 2005/0143189 | A1 * | 6/2005 | Lai et al. | 473/335 |
| 2006/0019769 | A1 | 1/2006 | Lo | |
| 2008/0045356 | A1 * | 2/2008 | Lin et al. | 473/346 |
| 2012/0178550 | A1 * | 7/2012 | Solheim et al. | 473/346 |

FOREIGN PATENT DOCUMENTS

| | | |
|---|---|---|
| JP | S60-43357 | 3/1985 |
| JP | S61-141380 | 6/1986 |
| JP | 3001818 | 6/1994 |
| JP | 3056395 | 4/2000 |
| JP | 2004-147694 | 5/2004 |
| JP | 2008148762 A | 7/2008 |

* cited by examiner

*Primary Examiner* — Sebastiano Passaniti
(74) *Attorney, Agent, or Firm* — Duane Morris LLP; J. Rodman Steele, Jr.; Gregory M. Lefkowitz

(57) ABSTRACT

There is provided a Ti alloy hollow club head which is more lightweight yet capable of realizing a better repulsion force by adjusting weight and thickness of a club head plate, with its strength ensured. Ribs are formed by chemically polishing the inner surface of a material of a crown plate to a 0.3 to 0.9 mm thickness, and a 0.3 to 4 mm width, and then first concave portions are formed to a 0.2 to 0.5 mm thickness. Thus, strength of the crown plate can be ensured by the ribs, while making the thickness thereof as thin as possible.

18 Claims, 5 Drawing Sheets

HOLLOW GOLF CLUB HEAD

CROSS-REFERENCE TO RELATED APPLICATIONS

This application claims priority to Japanese Patent Application No. JP 2010-135562, filed Jun. 14, 2010, the entire contents of which are incorporated herein by reference.

FIELD OF THE INVENTION

The present invention relates to a hollow golf club head such as a head for a wood-type golf club.

BACKGROUND OF THE INVENTION

As a conventional technique with respect to a hollow golf club head manufactured from a Ti alloy by casting or forging process, there is known a method for manufacturing a golf club head such that a whole or at least part of respective faces of an outer surface and/or an inner surface of a club head material is/are chemically polished to adjust its weight and thickness, thus enabling the thickness of a required part to be easily made thinner, as disclosed in Japanese Patent Publication No. 3056395.

Further, there is known another manufacturing method of a golf club head in which a photo-etching process is applied to a metal club head material either for adjustment of weight or thickness or for decoration purpose, as disclosed in Japanese Unexamined Patent Application Publication No. 2004-147694.

SUMMARY OF THE INVENTION

In order to set a weight balance of a golf club head more freely in a wood-type golf club, for example, thinning of a club head plate is required. According to the conventional techniques, however, thinning or reduction of thickness is performed only in a uniform manner on the club head plate, thereby leading to the limitation of thinning, or eventually to the limitation of adjustment of the weight and thickness of the club head. As a result, it has been impossible to obtain a golf club head with a better performance.

To eliminate the above problems, it is, therefore, an object of the invention to provide a hollow golf club head of a better performance that is realized by adjusting the weight and thickness of the plate material while ensuring the strength thereof According to a first aspect of the present invention, there is provided a hollow golf club head which includes a club head plate including thinned parts and ribs protruded therefrom, the thinned parts and ribs being formed by chemically polishing a certain area on a surface of a material of the club head plate to adjust weight and thickness of the club head plate, wherein the chemically-polished area on the surface of the material of the club head plate comprises:

a first area on which a plurality of the ribs are formed; and a second area surrounded with the plurality of the ribs to define the thinned parts, and wherein the thickness of the material of the club head plate is greater than that of the first area, and that of the first area is greater than that of the second area.

According to a second aspect of the present invention, there is provided the hollow golf club head according to the first aspect of the present invention, wherein the surface of the material of the club head plate is located on an inside of a crown plate, and the ribs are formed to have a thickness not less than 0.4 mm but less than the thickness of the material for the club head plate as well as a width in a range of from 0.4 to 4 mm, while the thinned parts are formed to have a thickness in a range of from 0.2 to 0.5 mm.

According to a third aspect of the present invention, there is provided the hollow golf club head according to the first aspect of the present invention, wherein the chemically-polished area on the surface of the material of the club head plate encompasses an uppermost inner area located corresponding to a top of the crown plate in a planar view such that the chemically-polished area makes up more than or equal to 60% of a whole inner surface of the crown when the club head is disposed on a horizontal plane at predetermined loft and lie angles.

According to the first aspect of the present invention, the thinned parts formed by the chemical polishing allows the thickness, eventually the weight of the club head plate to be reduced, and the ribs allows strength thereof to be ensured. Further, these thinned parts and the ribs can be precisely formed. In addition, an excess weight of the club head plate can be redistributed to a desired place, thereby enhancing degree of freedom of design such as adjustment of a center of gravity to thereby provide a golf club head of a better performance.

According to the second aspect of the present invention, the strength of the club head plate can be ensured.

According to the third aspect of the present invention, especially the strength of the crown can be ensured without spoiling an aesthetic appearance, and the lowered center of gravity can be achieved.

BRIEF DESCRIPTION OF THE DRAWINGS

The invention will be more readily understood by reference to the following description, taken with the accompanying drawings, in which.

DETAILED DESCRIPTION

Preferred embodiments of the present invention will now be described in detail with reference to the accompanying drawings. The embodiments described below are not to limit the scope of the present invention. Not every element of the present invention described below is essential.

First Embodiment

Figure 1:
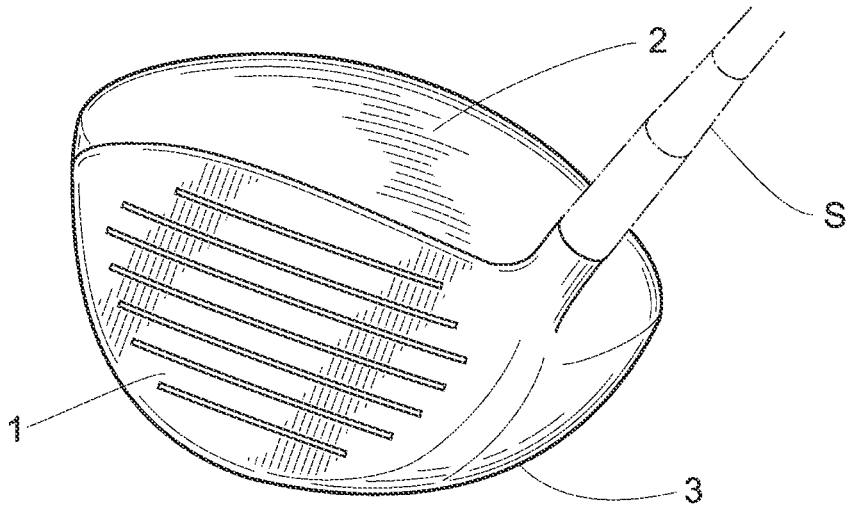
FIG. 1 is a perspective view showing a golf club head according to a first embodiment of the present invention.

FIGS. 1 to 6 show a first embodiment, and as shown in FIG. 1, a wood-type golf club head of the invention comprises a face plate 1 provided on a front, a crown plate 2 provided on a top and a sole-periphery plate 3 provided on a bottom and rear, which are each made of a Ti alloy such as β type Ti alloy and are joined together so as to define a hollow interior inside the club head. In addition, a shaft S is connected to one end of the club head.

Figure 2:
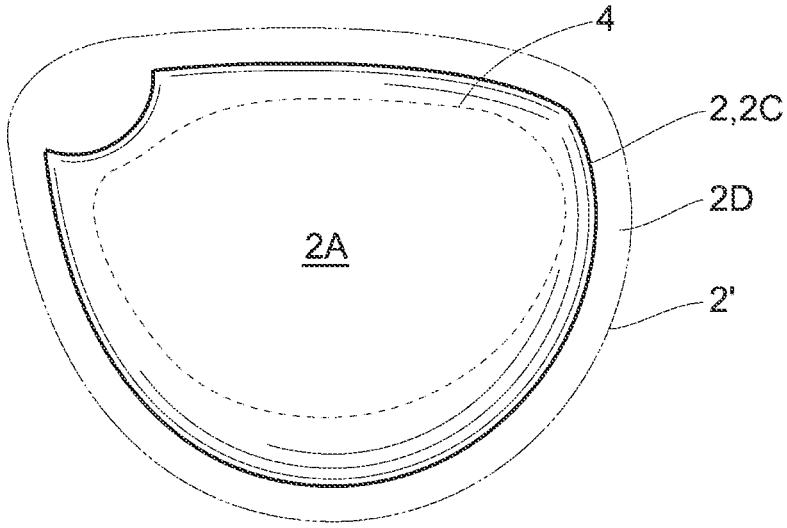
FIG. 2 is a top plan view showing a plate material for a crown portion thereof according to the first embodiment.
Figure 3:
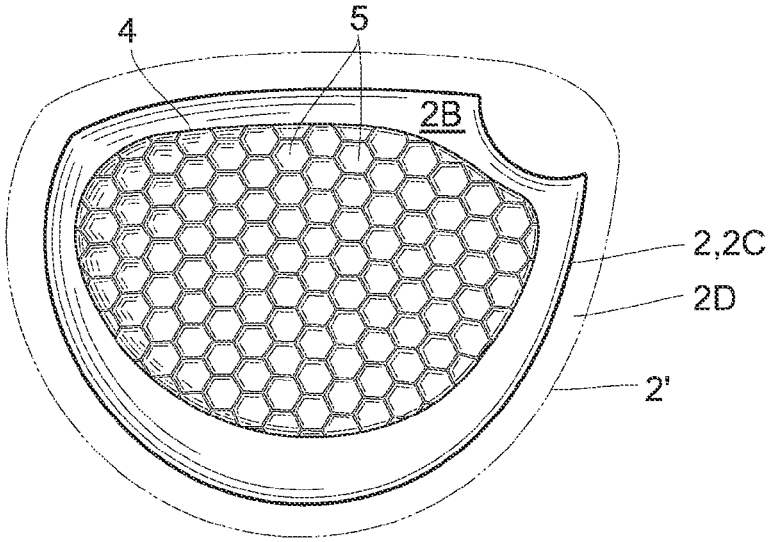
FIG. 3 is a bottom plan view showing the plate material for the crown portion according to the first embodiment.
Figure 4:
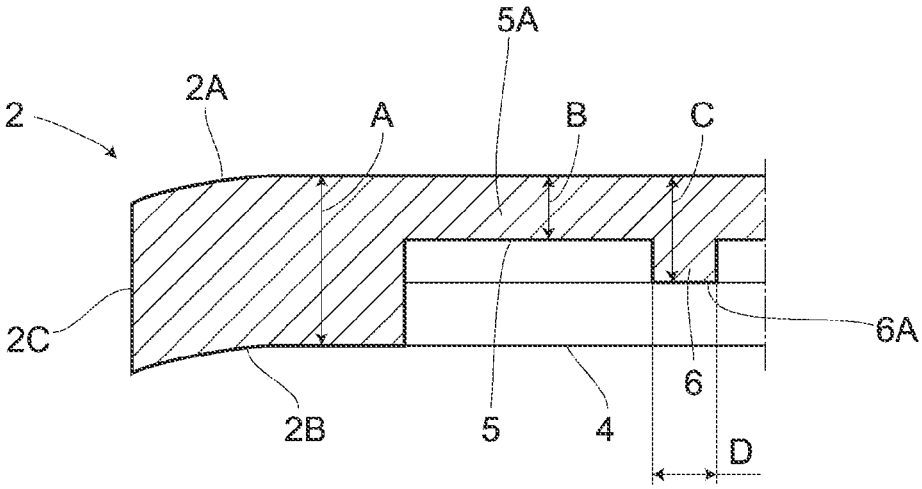
FIG. 4 is a cross sectional view showing a main section thereof according to the first embodiment.

According to the present embodiment, the crown plate 2 is formed thin to lower a center of gravity of the club head, as explained hereinbelow. As shown in FIG. 2 to FIG. 4, an outer surface 2A of the crown plate 2 is formed flat, while an inner surface 2B of the crown plate 2 is subjected to a process for reducing thickness. The process for reducing thickness of the inner surface 2B is performed in such a manner that, after formation of masking on a surrounding part of the inner surface 2B, a first area 4 which covers substantially an entire area of the inner surface 2B except the masked area is chemically polished to thereby form a first concave portion 5 that defines a thinned part 5A or a second area, as well as a rib 6 protruded downward from a predetermined position of the first concave portion 5. The masking process may be performed by immersion, brush coating, spray coating, taping or the like, and formation of the ribs 6 may be performed by silk screen, photo-etching, pad printing, laser or the like.

As shown in FIG. 4, if the thickness of a material for the crown plate 2 (hereinafter called a plate material 2' for crown) is denoted by thickness A when the outer surface 2A is used as a reference point for measurement, and in this way, the thickness of the thinned part 5A defined by the first concave portion 5 is denoted by thickness B, the thickness of the rib 6, i.e., a distance between the outer surface 2A and a rib surface 6A, is denoted by thickness C, and the width of the rib 6 in the lateral direction thereof is denoted by width D, then the thickness C is smaller than the thickness A, and the thickness B is smaller than the thickness C (i.e., A>C>B). The thickness A is less than or equal to 1 mm, preferably 0.8 mm or below. The thickness B is within a range of from 0.2 to 0.5 mm, preferably from 0.25 to 0.4 mm. The thickness C is within a range of from 0.3 to 0.9 mm, preferably from 0.45 to 0.8 mm, respectively. Note that if each of the thicknesses A, B and C is smaller than the corresponding value described above, strength of the club head becomes inferior. If each of the thicknesses A, B and C is larger than the corresponding value described above, then the crown plate 2 becomes so heavy, leading to the increased likelihood that adjusting the weight of the club head may become difficult.

In a planar view, the ribs 6 are arranged in the first area in a shape of a regular hexagon, and each of the ribs 6 is continuously arranged back and forth, and right and left within the first area 4, thereby arranging them in a honeycomb pattern. The width D of the rib 6 in a lateral direction is formed within a range from 0.3 to 4 mm, preferably 0.5 to 3.5 mm. If the width D is smaller than this value, reinforcing effect by the ribs 6 becomes too small. If it is larger than the above value, then the weight of the ribs 6 become so heavy, leading to the increased likelihood that adjusting the weight of the club head may become difficult.

Figure 5:
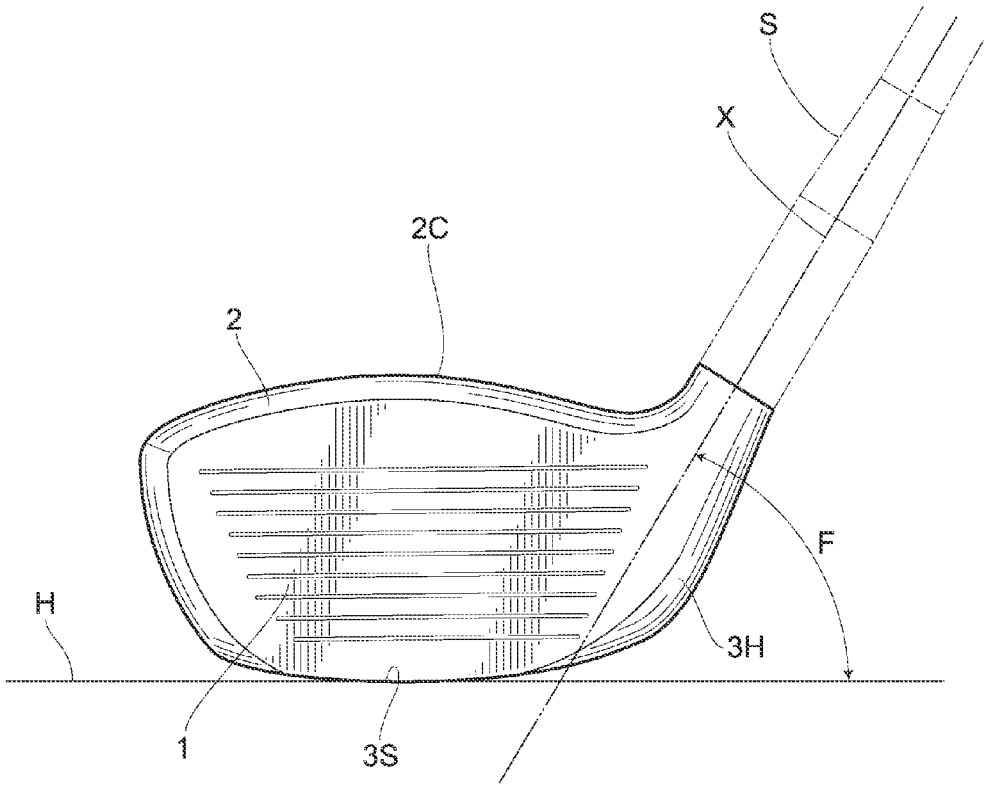
FIG. 5 is a front view showing the golf club head placed on a horizontal plane according to the first embodiment.
Figure 6:
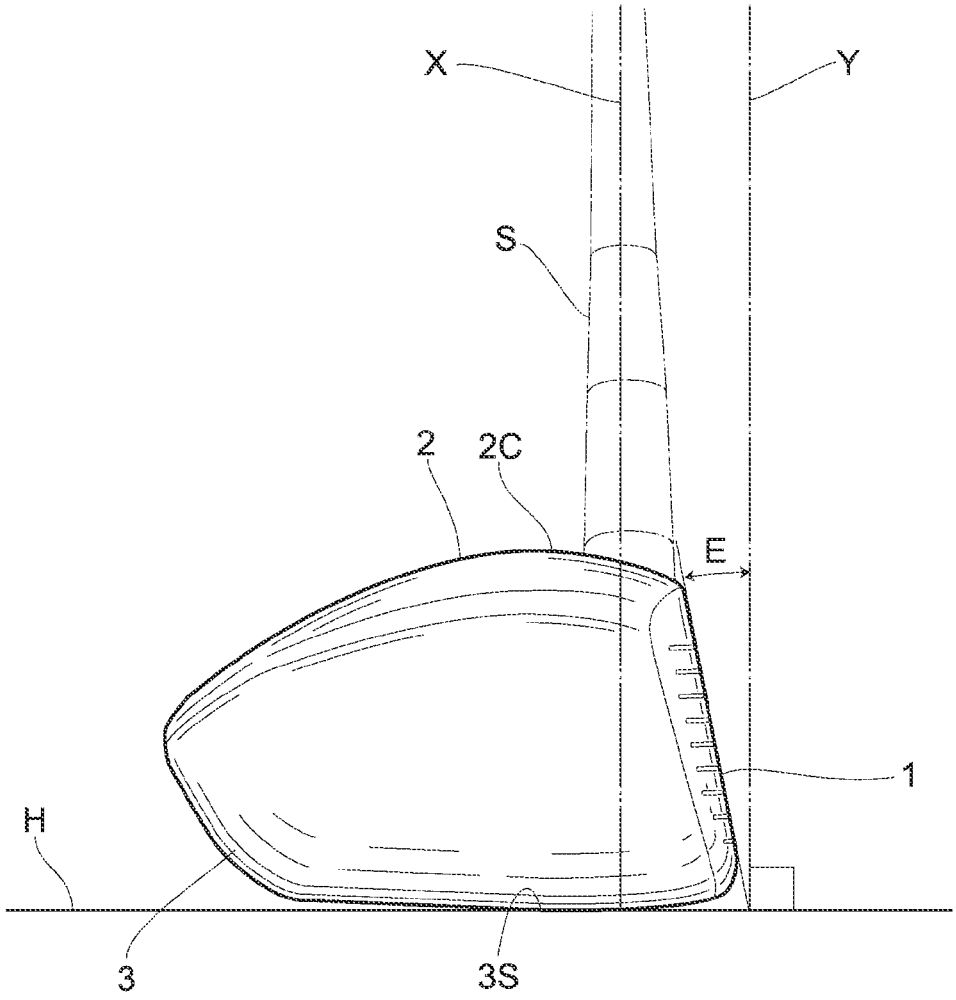
FIG. 6 is a side view showing the golf club head placed on a horizontal plane according to the first embodiment.

Furthermore, the chemically-polished area of the plate material 2' for crown, namely the first concave portion 5 and the rib 6, are formed such that the area on the surface of the material of said club head plate encompasses an uppermost inner area located corresponding to a top of the crown plate in a planar view such that the chemically-polished area makes up more than or equal to 60% of a whole inner surface of the crown when the club head is disposed on a horizontal plane at predetermined loft and lie angles, specifically when the club head is disposed on a horizontal plane H at a predetermined loft angle E and lie angle F as shown FIG. 5 and FIG. 6. Here, the loft angle E is an upper angle of a front surface of the face plate 1 against a center axis X of the shaft S, and the lie angle F is an angle which the horizontal plane H and the shaft S make at the side of a heel 3H when a sole 3S of the golf club is properly disposed on the horizontal plane H. The front surface of the face plate 1 is hereinafter called a hitting surface. Incidentally, symbol Y in FIG. 6 represents a virtual vertical surface which is parallel to the center axis X of the shaft S and is arranged vertically from the point at the intersection of an extending surface of the hitting surface and the horizontal plane H. The loft angle E is defined by the virtual vertical surface Y and the hitting surface.

Although the crown plate 2 is described as one example of a club head plate according to the present embodiment, the present invention should not be limited thereto, but may be applied to any other plate members, such as the sole-periphery plate 3.

As described above, according to the present embodiment, the inner surface 2B of the crown plate material 2' is chemically polished so as to define not only the thickness C of the rib 6 but also the thickness B of the first concave portion 5, thereby enabling the crown plate material 2' to be thinned by the first concave portion 5, while ensuring the crown plate material 2' to be strengthened by the ribs 6 to withstand external shocks.

Additionally, the thickness B of the first concave portion 5 is within a range from 0.2 to 0.5 mm, thereby allowing the crown plate 2 to be as thin as possible. Also, the thickness C of the rib 6 is within a range from 0.3 to 0.9 mm and the width D of the rib 6 is within a range from 0.3 to 4.0 mm, thereby allowing the crown plate 2 to be strengthened.

In addition, the first concave portions 5 and the ribs 6 which are formed by being chemically polished are provided on more than or equal to 60% of the whole inner surface area of the crown 2C, thereby allowing the crown 2C to be strengthened without spoiling the aesthetic appearance thereof, while allowing the center gravity of the club head to be lowered. Incidentally, if the first concave portions 5 and the ribs 6 are formed on less than 60% of the whole inner surface area of the crown 2C, it is not possible to allow the crown 2C to be strengthened without spoiling the aesthetic appearance thereof.

Second Embodiment

Figure 7:
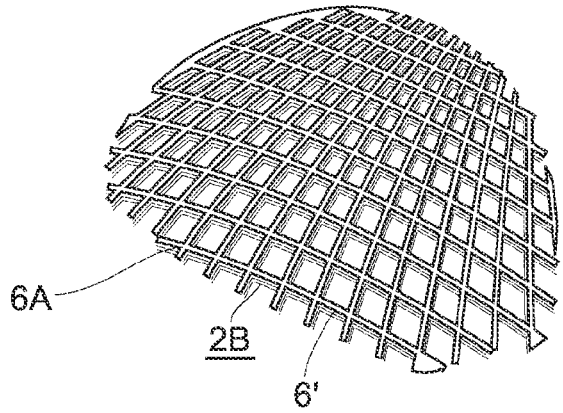
FIG. 7 is a perspective view showing a main part thereof according to a second embodiment of the present invention.

As shown in FIG. 7, there are provided a plurality of ribs 6' on the inner surface 2B of the crown plate 2 such that they are arranged in a rectangular lattice pattern in a planar view by allowing them to intersect with each other at right angles. Such lattice-patterned ribs 6' also enable reduction of the weight of the crown plate 2, while ensuring its strength.

Third Embodiment

Figure 8:
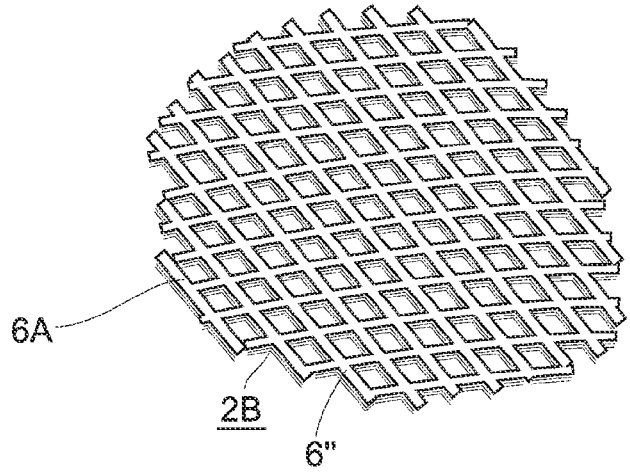
FIG. 8 is a perspective view showing a main part thereof according to a third embodiment of the present invention.

As shown in FIG. 8, there are provided a plurality of a ribs 6" on the inner surface 2B of the crown plate 2 such that they are arranged in a rhombic lattice pattern in a planar view by allowing them to intersect with each other at angles other than a right angle. Such rhombic ribs 6" also enable reduction of the weight of the crown plate 2, while ensuring its strength.

Fourth Embodiment

Figure 9:
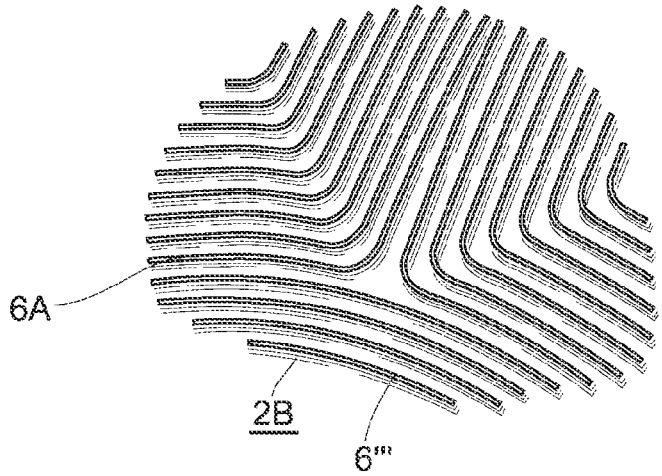
FIG. 9 is a perspective view showing a main part thereof according to a fourth embodiment of the present invention.

As shown in FIG. 9, there are provided a plurality of a ribs 6''' on the inner surface 2B of the crown plate 2 such that they are arranged in parallel with each other so as not to intersect with each other. Such ribs 6" also enable reduction of the weight of the crown plate 2, while ensuring its strength.

The present invention is not limited to the foregoing embodiments, and various modifications are possible within the scope of the gist of the present invention.

What is claimed is:

1. A hollow golf club head comprising a club head plate including thinned parts and ribs protruded therefrom, said thinned parts and ribs being formed by chemically polishing a certain area on a surface of a material of said club head plate to adjust weight and thickness of said club head plate;

wherein the chemically-polished area on the surface of the material of said club head plate comprises:

a first area on which a plurality of said ribs are formed, and a second area surrounded with the plurality of said ribs to define said thinned parts, wherein the thickness of the material of said club head plate is greater than that of said first area, and that of said first area is greater than that of said second area; and wherein the surface of the material of said club head plate is located on an inside of a crown plate, and said ribs are formed to have a thickness not less than 0.4 mm but less than the thickness of the material for the club head plate as well as a width in a range of from 0.4 to 4 mm, while said thinned parts are formed to have a thickness in a range of from 0.2 to 0.5 mm.

2. The hollow golf club head according to claim 1, wherein said thinned parts formed by the chemical polishing are allowed to define concave portions so that said ribs are protruded from predetermined places on the concave portions.

3. The hollow golf club head according to claim 1, wherein said ribs are arranged in a shape of a regular hexagon, and each of said ribs is continuously arranged back and forth, and right and left to be arranged in a honeycomb pattern.

4. The hollow golf club head according to claim 1, wherein said ribs are arranged in a rectangular lattice pattern in a planar view by allowing them to intersect with each other at right angles.

5. The hollow golf club head according to claim 1, wherein said ribs are arranged in a rhombic lattice pattern in a planar view by allowing them to intersect with each other at angles other than a right angle.

6. The hollow golf club head according to claim 1, wherein said ribs are arranged in parallel with each other so as not to intersect with each other.

7. The hollow golf club head according to claim 1, wherein the material of said club head plate is that for a crown plate.

8. The hollow golf club head according to claim 1, wherein the material of said club head plate is that for a sole-periphery plate.

9. A hollow golf club head comprising a club head plate including thinned parts and ribs protruded therefrom, said thinned parts and ribs being formed by chemically polishing a certain area on a surface of a material of said club head plate to adjust weight and thickness of said club head plate;

wherein the chemically-polished area on the surface of the material of said club head plate comprises:

a first area on which a plurality of said ribs are formed, and a second area surrounded with the plurality of said ribs to define said thinned parts, wherein the thickness of the material of said club head plate is greater than that of said first area, and that of said first area is greater than that of said second area; and wherein the chemically-polished area on the surface of the material of said club head plate encompasses an uppermost inner area located corresponding to a top of the crown plate in a planar view such that the chemically-polished area makes up more than or equal to 60% of a whole inner surface of the crown when the club head is disposed on a horizontal plane at predetermined loft and lie angles.

10. The hollow golf club head according to claim 9, wherein the material of said club head plate is that for a crown plate.

11. The hollow golf club head according to claim 9, wherein the material of said club head plate is that for a sole-periphery plate.

12. The hollow golf club head according to claim 9, wherein said thinned parts formed by the chemical polishing are allowed to define concave portions so that said ribs are protruded from predetermined places on the concave portions.

13. The hollow golf club head according to claim 9, wherein said ribs are arranged in a shape of a regular hexagon, and each of said ribs is continuously arranged back and forth, and right and left to be arranged in a honeycomb pattern.

14. The hollow golf club head according to claim 9, wherein said ribs are arranged in a rectangular lattice pattern in a planar view by allowing them to intersect with each other at right angles.

15. The hollow golf club head according to claim 9, wherein said ribs are arranged in a rhombic lattice pattern in a planar view by allowing them to intersect with each other at angles other than a right angle.

16. The hollow golf club head according to claim 9, wherein said ribs are arranged in parallel with each other so as not to intersect with each other.

17. A hollow golf club head comprising a club head plate including thinned parts and ribs protruded therefrom, said thinned parts and ribs being formed by chemically polishing a certain area on a surface of a material of said club head plate to adjust weight and thickness of said club head plate;

wherein the chemically-polished area on the surface of the material of said club head plate comprises:

a first area on which a plurality of said ribs are formed, and a second area surrounded with the plurality of said ribs to define said thinned parts, wherein the thickness of the material of said club head plate is greater than that of said first area, and that of said first area is greater than that of said second area wherein said ribs are arranged in a shape of a regular hexagon, and each of said ribs is continuously arranged back and forth, and right and left to be arranged in a honeycomb pattern; and wherein the material of said club head plate is that for a crown plate.

18. A hollow golf club head comprising a club head plate including thinned parts and ribs protruded therefrom, said thinned parts and ribs being formed by chemically polishing a certain area on a surface of a material of said club head plate to adjust weight and thickness of said club head plate;

wherein the chemically-polished area on the surface of the material of said club head plate comprises:

a first area on which a plurality of said ribs are formed and a second area surrounded with the plurality of said ribs to define said thinned parts, wherein the thickness of the material of said club head plate is greater than that of said first area, and that of said first area is greater than that of said second area;

wherein said ribs are arranged in a shape of a regular hexagon, and each of said ribs is continuously arranged back and forth, and right and left to be arranged in a honeycomb pattern; and wherein the material of said club head plate is that for a sole-periphery plate.

* * * * *